United States Patent [19]

Wilkinson

[11] 4,057,201

[45] Nov. 8, 1977

[54] YARN CORE INCLUDING SLIP RESISTANT TRANSFER COATING

[75] Inventor: Robert M. Wilkinson, Florissant, Mo.

[73] Assignee: Alton Box Board Company, Alton, Ill.

[21] Appl. No.: 696,574

[22] Filed: June 16, 1976

[51] Int. Cl.[2] ..... B65H 75/28

[52] U.S. Cl. ..... 242/125.1

[58] Field of Search ..... 242/125.1, 125, 125.2, 242/125.3, 18 PW, 18 EW, 18 A, 118.32, 118.3

[56] References Cited

U.S. PATENT DOCUMENTS

| | | | |
|---|---|---|---|
| 2,327,738 | 8/1943 | Perry | 242/118.32 |
| 2,765,129 | 10/1956 | Dunlap | 242/118.32 |
| 3,378,211 | 4/1968 | Nuissl | 242/18 A |
| 3,876,165 | 4/1975 | Comer | 242/125.1 |
| 3,967,795 | 7/1976 | Shindo et al. | 242/125.1 |

*Primary Examiner*—George F. Mautz
*Attorney, Agent, or Firm*—Paul M. Denk

[57] ABSTRACT

A yarn core, either formed to a cylindrical shape, or in a cone configuration, includes a shallow cavity approximate one end, and within the cavity, around the circumference of the core, there is included a coating of a slip resistance material, preferably formed as a colloidal silica, to enhance the coefficient of friction at this location so as to temporarily adhere the yarn thereto either while it is being wound onto the core, or during unwinding as, for example, weaving proceeds from one depleted yarn core to a new core of yarn.

3 Claims, 5 Drawing Figures

YARN CORE INCLUDING SLIP RESISTANT TRANSFER COATING

BACKGROUND OF THE INVENTION

This invention relates generally to yarn cores, but more particularly pertains to a core having a ring of slip resistant material, such as a colloidal silica so as to enhance yarn transfer from core to core.

As is well known in this art, certain problems have been encountered in the textile field in the manufacture of yarn or thread, particularly those that are wound on a core or other type of bobbin. During the high speed performed process of manufacturing yarn, the continually advancing yarn is wound onto successive and rapidly rotating cores. As a new core encounters the lead stand of yarn or thread, it frictionally engages the incoming yarn with the rotating core so as to achieve an initial wind of said yarn onto the core and simultaneously break the yarn at a location between the nozzle of the thread producing gun and the point of its engagement with the said core. Hence, it is a quite delicate operation to achieve this process successfully, and therefore, much attention has been given in prior development to produce a textile core that can operate successfully and continuously without mishap.

Various styles of prior cores have been devised in an effort to remedy the foregoing problem. Usually the prior art cores are either physically roughened upon their surface so as to attain a higher coefficient of friction, so that the yarn will be temporarily retained as it is being wound onto a fresh core. Developments of this type are shown in earlier prior art patent to Dunlap, U.S. Pat. No. 2,765,129, wherein the core surface has applied thereto an adhesive with discrete fibres then being secured to the adhesive so as to stimulate friction. The United States patent to Howle, U.S. Pat. No. 3,165,564, discloses another method for roughening the surface of a plastic tubular body so as to enhance its friction and to attain yarn retention during the winding process. Other type yarn carriers have entailed the expense of actually molding a roughened surface onto the outer periphery of the core, such as shown in the United States patent to Krebs, U.S. Pat. No. 3,141,631.

Still other prior art developers have attempted to enhance the coefficient of friction for the outer surface of a yarn core, such as shown in the United States patent to Comer, U.S. Pat. No. 3,876,165, wherein a knurled configuration is provided approximate one end of the core to attain such. The problem with this type of transfer ring is that usually a textile core, particularly one formed from a paper wound tube, includes an outer layer of a very smooth surface parchment or kraft paper so as to insure no obstruction to yarn transfer at any other position along the length of the core except at the location of the transfer ring. Hence, when some instrumentation is utilized to form a knurling at the location of the transfer ring, such actually penetrates into this outer covering of paper, which has a tendency to destroy or detract from the purpose for the cores use causing its reject. Still other prior art manufacturers have taken a different approach to the formation of this transfer ring, wherein instead of enhancing the coefficient of friction by modifying the surface features of the core itself, they have formed or cut a groove into the circumference of the textile core, within the vicinity of the transfer ring, and hopefully have the yarn or thread enter into the groove, and be bound therein, so as to attain the necessary resistance so as to achieve a break of the yarn from the just preceeding core, while at the same time furnish the necessary resistance so that the yarn can be wound upon this new core. As can be seen in the United States patent to Sowell, U.S. Pat. No. 3,284,023, and the United States patent to Adams, et al, U.S. Pat. No. 3,717,291, their formed grooves can undertake rather precise configurations within the core per se. And, when cores of these previous type of designs are assembled under their respective manufacturing processes, they usually require either additional materials to attain their final configuration, which by necessity includes further steps in their manufacturing process, or they induce a physical damaging of the core surface, such as occurs in those prior art developments that disclose the cutting of a groove into the core surface. It is, therefore, the principle object of this invention to provide a transfer core for textile yarn or thread which includes an annular coating of a slip resistant material that effectively resists transfer of the thread upon a momentary contact with the same during a winding process.

A further object of this invention is to provide a transfer ring for a yarn core that incorporates a cavity having a quantity of slip resistant material coated therein.

Another object of this invention is to provide a textile core that includes a slip resistant transfer ring that can be easily applied as a final step in the winding of the textile core.

These and other objects will become more apparent to those skilled in the art upon reviewing the summary of this invention, and upon undertaking a study of the description of its preferred embodiment in view of the drawing.

SUMMARY OF THE INVENTION

This invention contemplates the use of a spiral or convolutely wound paper tube, comprising a cylindrical like member, and having either a cylindrical configuration, or even being shaped into the configuration of a cone. The tube, upon its outer ply, will preferably include a sheet of smooth faced paper so as to allow for the ease of transfer of yarn or thread to or from the same, and further includes a transfer ring proximate its bottom portion and that facilitates the initial temporary retarding of the thread thereagainst as it is beginning to be wound upon the tube. This transfer ring may be indented, as around the circumference of the tube, and then be coated with a slip resistant composition that enhances the surface coefficient of friction for the purposes as just previously defined. The reason for the indentation is to provide a shallow depression into which the coating material may be deposited, inwardly of this outer surface of the tube, thereby preventing any accidental removal of the coating from the tube surface as by scuffing as during shipment or other handling of tubes of this nature.

The anti-slip or slip resistant composition may comprise an aluminum or silica anti-skid compound such as are available upon the market, and compositions of this type may be acquired from Monsanto Company, of St. Louis, Missouri, and identified under the trademark Sytron EZ-50.This particular composition comprises a colloidal silica, which is a slip resistant composition that may be processed and obtained from silica aquasols, from silica organo-aquasols, silica organosols, such as are available in the art. The coating material may be applied to the desired location of the transfer ring by means of a roller or similar type instrument, and may be applied during the final step in the process of winding of the tube or cone itself. Where the composition is applied within an indentation or shallow cavity provided at the desired location for the ring, such a cavity may be formed just prior to the roller application of the material onto the ring, and such a cavity may be attained from a pressure roll or similar type instrument, which instrument applies the shallow cavity as the step next preceeding the application of the friction inducing coating itself.

Various other types of slip resistant coatings may also be applied to form the complete transfer ring of this invention, and such a coating as can be acquired from Michelman Chemicals, Inc., of Cincinnati, Ohio, and is identified under the brand name Resisto-Slip.

Related types of slip resistant compositions are further available upon the market, and such may be attained from Dupont Company, of Wilmington Delaware, and sold by the tradename Ludox AM. This particular material also comprises a colloidal silica, and may be attained from silica-aquasols, as aforesaid, and may either comprise a water soluable type of aqueous dispersion that contains an alkali-stabilized colloidal silica. In addition, the composition may be combined or dispersed within a water-insoluable organic polymer where a more enduring type of coating material is desired for the slip resisting transfer ring of this invention.

It may be commented, that when desired, such a coating may be applied over the entire surface of the cylindrical bobbin or cone, so as to enhance the entire slip resistant characteristic of the whole surface of the cone. But, for routine commercial purposes, it is believed that a wide band transfer ring of one of the identified materials will produce the satisfactory results required.

BRIEF DESCRIPTION OF THE DRAWING

In the drawing, FIG. 1 discloses a bobbin or cylinder having the transfer ring of this invention proximate its one end.

DESCRIPTION OF THE PREFERRED EMBODIMENT

Figure 1:
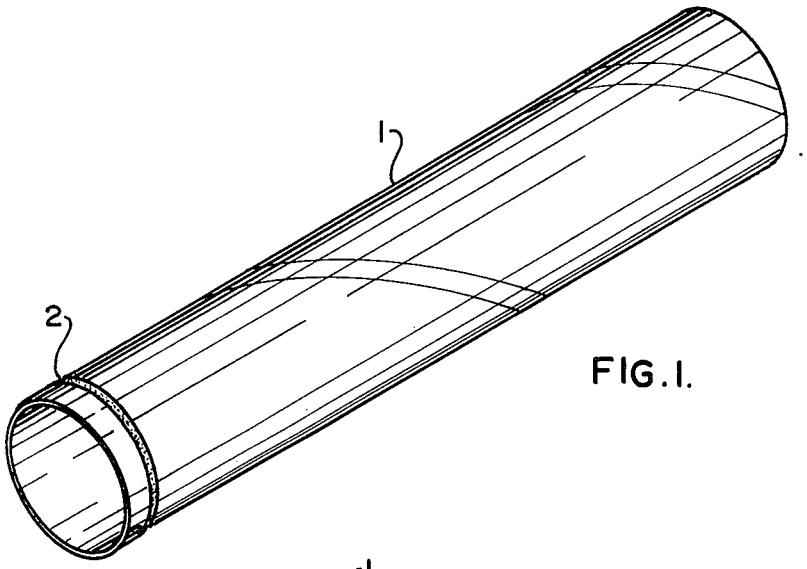
Figure 2:
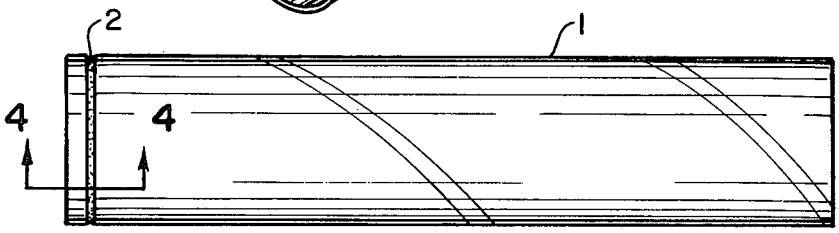
FIG. 2 provides a side view of the invention of FIG. 1.
Figure 3:
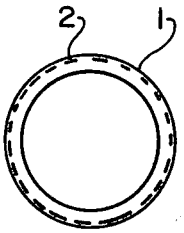
FIG. 3 provides an end view of the invention of FIG. 1.
Figure 4:
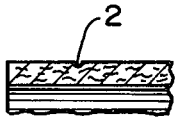
FIG. 4 discloses a partial sectional view, slightly enlarged, displaying the shallow cavity holding the coating material of this invention and forming of the transfer ring, as taken along the line 4—4 of FIG. 1.

In referring to FIGS. 1 through 3 of the drawing, there is disclosed a spirally wound paper tube 1, in this particular instance, comprising a cylindrical tube, having sufficient length to hold and support a large quantity of yarn, thread, or the like. This type of core is currently used in the textile trade, as described in the background of this invention, and generally is formed as paper wound tubes, or even of a plastic, but in this particular embodiment, it is desired to form the core as a paper tube either of the spirally wound type, as shown, or as a convolutely wound core. Proximate to one end, and normally the lower end of the cylindrical core, is the transfer ring 2 of this invention. As shown, the ring is formed as a slight indentation and providing a shallow cavity around the circumference of the tube at this location, and coated within this cavity is a slip resistant material of one of the types as previously defined under the summary of this invention. The degree of indentation provided to the core in the formation of its transfer ring is shown in a slightly enlarged sectional view, as in FIG. 4, and provides a sufficient cavity 2 so as to hold a quantity of the coating material therein, and therein being shielded from surface scuffing, but also, to act as an index formed groove into which the yarn or thread may be initially guided during incipient winding of such upon this core. While the cavity shown at 2 may be somewhat narrow in width, it is just as likely that this indentation may also comprise a wider band for the transfer ring so as to facilitate the initial contact of the thread with the ring during the winding process.

Figure 5:
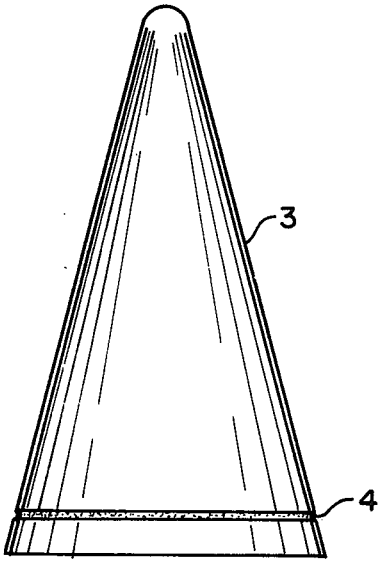
FIG. 5 discloses a modification to this invention wherein instead of a cylinder, the core is formed in the configuration of a cone, but yet having the transfer ring of this invention provided circumferentially proximate its base.

FIG. 5 discloses a slightly modified embodiment of this invention, such modification being more in the cylindrical member forming the core itself, in this particular instance, being in the shape of a cone 3. The cone is formed with a similar type transfer ring 4 approximate its downwardly disposed base, and once again this ring is configured to provide a shallow depression to form the type of cavity for the purposes as previously described. But, it is likewise conceivable that no such cavity may be provided in the vicinity of the transfer ring, but rather, the slip resistant coating may be applied directly to the surface of the cylinder or cone in either a narrow or wide band to form the transfer ring thereat. Also, as previously analyzed, it is likely that the entire surface of this cone, just as with the cylinder, could be coated with this slip resistant material so that the entire device exhibits the attributes of an increased coefficient of friction that readily adheres with the yarn or thread brought into contact with the same. Although providing a transfer ring of this type upon a core might first give one the impression upon inspection that the composition forms a tacky like consistency on the surface of the same, the slip resistant coating, due to its chemical composition, more naturally forms a rather abrasive or non-skidding feeling to the touch that produces the type of surface coefficient of friction that will accommodate the type of material being handled and accomplish the objectives of this invention.

Other variations may occur to those skilled in the art upon reviewing the subject matter of this disclosure. Such variations, if within the spirit and scope of the claims appended hereto, are intended to be protected by any patent issuing hereon. The description of the preferred embodiment as set forth is primarily for illustrative purposes only, and is not meant to be limiting of the scope of this invention.

Having thus described the invention, what is claimed and desired to be secured by Letters Patent is:

1. A yarn core having a transfer coating comprising, a length of cylinder like member, said member having a smooth outer covering to assist in yarn winding and transfer, a frictional transfer ring provided proximate one end of the core and formed of a slip resistant coating material to facilitate the engagement of yarn, said transfer ring including a shallow cavity formed in the cylindrical like member at the vicinity of the said ring, and including the slip resistant coating material applied therein, said slip resistant coating material comprising a composition of a colloidal silica that enhances the coefficient of friction of the transfer ring and effectively temporarily adheres the yarn as it is being wound with respect to the core.

2. The invention of claim 1 wherein said cylindrical like member comprises a cylinder of a paper wound tube throughout its extent.

3. The invention of claim 1 wherein said cylindrical like member comprises a wound paper cone.

* * * * *